United States Patent [19]

Akesaka

[11] Patent Number: 4,692,062

[45] Date of Patent: Sep. 8, 1987

[54] SHIELD TYPE TUNNELING MACHINE

[75] Inventor: Toshio Akesaka, Yokohama, Japan

[73] Assignee: Kabushiki Kaisha Iseki Kaihatsu Koki, Tokyo, Japan

[21] Appl. No.: 780,388

[22] Filed: Sep. 26, 1985

[30] Foreign Application Priority Data

Oct. 25, 1984 [JP] Japan ..... 59-160343[U]

[51] Int. Cl.[4] ..... E21D 9/08

[52] U.S. Cl. ..... 405/141; 299/33; 299/58

[58] Field of Search ..... 405/141, 144, 184; 299/33, 55, 56, 58

[56] References Cited

U.S. PATENT DOCUMENTS

| | | | |
|---|---|---|---|
| 3,334,945 | 8/1967 | Bartlett | 405/144 X |
| 3,830,545 | 8/1974 | Sugden | 299/33 |
| 4,171,848 | 10/1979 | Ono | 405/141 X |
| 4,298,230 | 11/1981 | Krabbe | 299/33 |
| 4,406,498 | 9/1983 | Akesaka | 405/144 X |

*Primary Examiner*—David H. Corbin

*Attorney, Agent, or Firm*—Kane, Dalsimer, Kane, Sullivan and Kurucz

[57] ABSTRACT

A shield-type tunneling machine comprises a shield body having a front portion converging gradually rearward, a crankshaft journalled rotatably by a diaphragm provided in the shield body, a drive mechanism connected to an end of the crankshaft and a conical or frustoconical rotary head supported rotatably by the other end and disposed in the front portion of the shield body to be turned eccentrically, a gear mechanism for forcibly rotate the rotary head and a means for discharging debris from a front area of the diaphragm to a rear area. The tunneling machine, when thrusted in the ground by a jack, receives earth and sand into the front portion of the shield body and compresses them between the rotary head and the shield body to send them to the rear. The machine can be used for a pipe jacking as well as the tunneling in the soft ground.

5 Claims, 3 Drawing Figures

SHIELD TYPE TUNNELING MACHINE

BACKGROUND OF THE INVENTION

1. Field of the Invention:

This invention relates to a shield type tunneling machine, and more particularly, to a shield type tunneling machine adapted to use in a pipe jacking method for thrusting a pipe in the ground.

2. Description of the Prior Art:

In a pipe jacking method, as disclosed in U.S. patent Ser. No. 4,311,411, is disposed a shield type tunneling machine in the foremost portion of a plurality of pipes to be thrusted. While a tunnel face is excavated by the operation of a rotary cutter head provided in the tunneling machine, a thrust is given to said pipe and the fore tunneling machine by a thrusting jack provided in a shaft and adjacent the rearmost pipe. Therefore, both the pipe and the tunneling machine are thrusted in the ground excavated by the operation of said cutter head.

The rotary cutter head is disposed spaced ahead from a diaphragm crossing the interior of a shield body, and debris excavated from a face during thrusting of said tunneling machine and pipe enters and fills a front area between said cutter head and said diaphragm through said cutter head. The debris filling said front area of the diaphragm serves to transmit the earth pressure on the face to the diaphragm of the shield body and the reaction of the diaphragm to the face so that the face is stably maintained without collapse or upheaval by balance between the reaction and the earth pressure.

Conventionally, the debris is rotated with said cutter head in the front area of said diaphragm and directed toward a discharging means such as a screw conveyer provided on a lower portion of said diaphragm and discharged through the discharging means to the rear of the diaphragm. However, a large frictional force works between the rotating debris and said diaphragm so that large torque is needed for the rotation of said cutter head. Thus, the provision of a compact drive unit for the cutter head and a compact shield type tunneling machine for a pipe jacking method is hindered, i.e. the provision of a small diameter shield body is difficult.

While the reduction of frictional force between the debris and the diaphragm has to be considered particularly during the excavation and thrusting in the gravel ground, an embodiment of effective method of reducing the friction was conventionally executed in which pressurized high concentration muddy water is applied to the face to stabilize the face and give fluidity to the debris. However, the use of the pressurized muddy water needs the subsequent treatment of muddy water mixed with debris, and further the treatment presents problems concerning installation, cost or the like. In addition, said frictional force is increased in proportion to pressure exerted to the debris filling the front area of said diaphragm. Therefore, the pressure needs to be reduced as small as possible for reducing the frictional force. However, since the pressure acting on the debris cannot be reduced lower than the active earth pressure of the face ground to stabilize the face, the reduction of said frictional force by the lubricating action of the muddy water was naturally limited.

SUMMARY OF THE INVENTION

An object of the present invention is to reduce the frictional force produced by rotating debris or mined material together with the cutter head in the front area between the cutter head and the diaphragm and acting between said diaphragm and said debris.

A further object of the present invention is to provide a shield type tunneling machine which can be used for the ground covering a wide range from the soft ground to the hard ground.

A shield type tunneling machine according to the present invention comprises a shield body having a front portion having approximately definite inner diameter or converging gradually rearward, a diaphragm provided in a rear of said front portion to cross said shield body, a crankshaft supported rotatably by said diaphragm and having one end connected to a drive mechanism provided in a rear of said diaphragm and the other end extending in front of said diaphragm, a conical or frustconical rotary head supported rotatably by said other end of the crankshaft and disposed in the front portion of said shield body, a grear mechanism for forcibly rotating said rotary head and including an internal gear fixed to one of said diaphragm and rotary head and an external gear fixed to the other and a means for discharging debris from a front area of said diaphragm to a rear area.

According to the present invention, debris received between the rotary head turning and rotating in the direction opposite to that of turning and the whole inner peripheral surface of the shield body is condensed and moved linearly to be introduced into a discharge port. As a result, friction acting on the debris, the diaphragm of the shield body and other portions of the tunneling machine can be reduced.

The above-mentioned and other objects and features of the invention will become apparent from the following detailed description taken in conjunction with the drawings which indicate embodiments of the invention.

DESCRIPTION OF THE PREFERRED EMBODIMENTS

Figure 1:
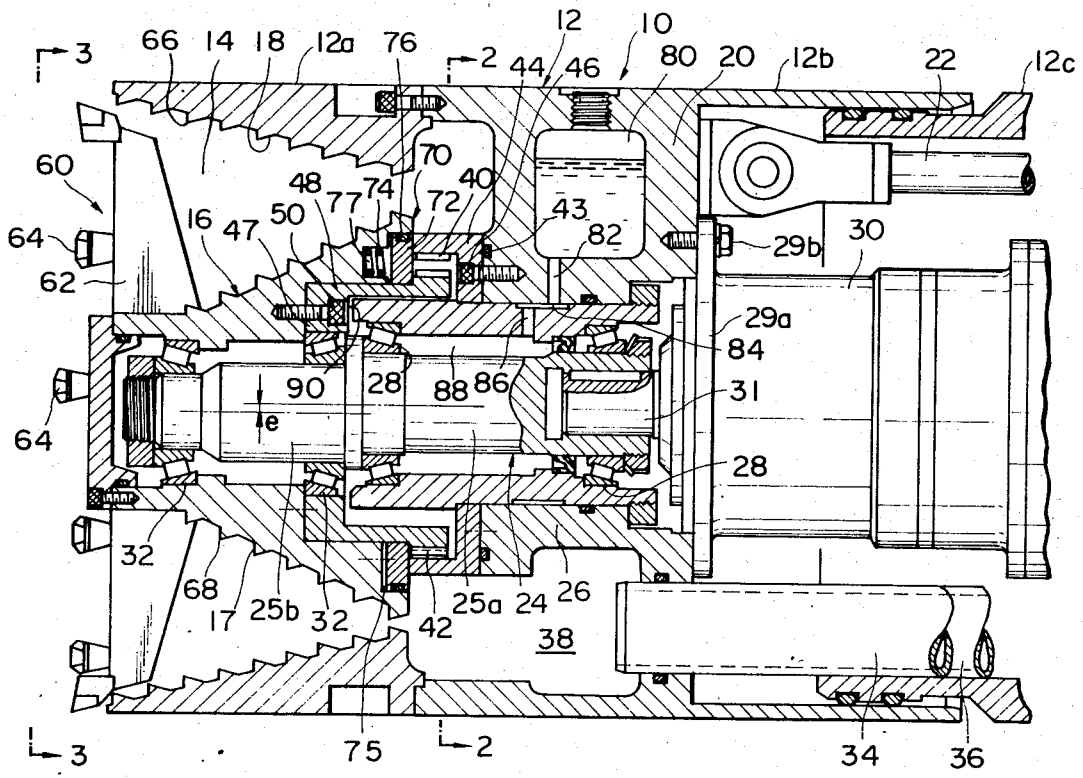
FIG. 1 is a longitudinal sectional view showing a shield propelling device according to the present invention.

As shown in FIG. 1, a shield type tunneling machine 10 according to the present invention includes a shield body 12 having a front portion 12*a*, intermediate portion 12*b* and rear portion 12*c* and a gnerally conical rotary head 16 disposed in a space 14 within the front portion 12*a* of the shield body. When the tunneling machine 10 is used for a pipe jacking method, as is well known to the skilled in the art, a plurality of pipes made of steel or concrete (not shown) are connected to each other behind the shield body 12 and further behind to these pipes is connected a hydraulic jack (not shown) disposed in a shaft to give a thrust to these pipes.

The front portion 12*a* of the shield body 12 has the bore converging gradually rearward and an inner peripheral surface 18 surrounds the space 14. The intermediate portion 12*b* behind the front portion 12*a* of the shield body 12 is provided with a diaphragm 20 crossing the shield body. In the intermediate portion 12*b* of the shield body 12 are disposed a plurality of direction correcting jacks 22 (only one of the jacks is shown in FIG. 1) behind the diaphragm 20.

Figure 2:
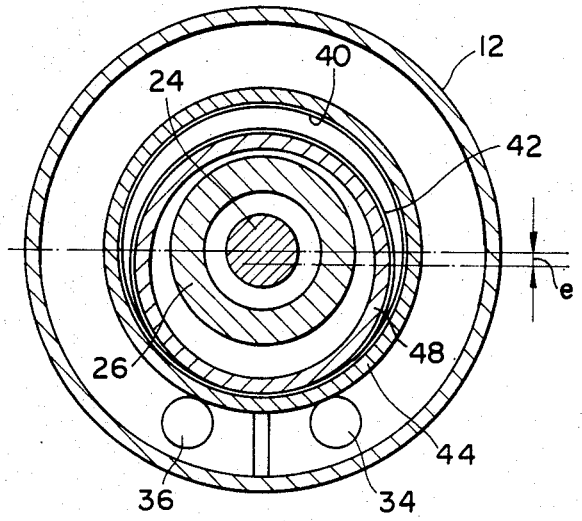
FIG. 2 is a small scale sectional view taken along the line 2—2 in FIG. 1.

A crankshaft 24 for supporting and turning eccentrically the rotary head 16 is provided. A shaft portion 25*a* at one end side of the crankshaft 24 is journalled by a pair of roller bearings 28 attached to a collar 26 mounted on the diaphragm 20. Also, the shaft portion 25*a* is keyed on an output shaft 31 of a drive mechanism 30 including a motor and a reduction gear fixed through a bracket 29*a* to the diaphragm 20 by bolts 29*b*. On the other hand, a shaft portion 25*b* at the other end side of the crankshaft 24 journals the rotary head 16 through a pair of roller bearings 32 attached to the rotary head 16. The crankshaft 24 has an eccentricity e (see FIGS. 1 and 2) between the shaft portions 25*a* and 25*b*.

A pair of pipes 34,36 extending through the diaphragm are mounted on a lower portion of the diaphragm 20. Both pipes 34,36 are opened toward the front of the diaphragm to communicate to a debris chamber 38 formed in front of the diaphragm 20 in the intermediate portion 12*b* of the shield body. The pipe 34 is a liquid supply pipe for supplying liquid such as muddy water and clean water to the front of the diaphragm 30, and the pipe 36 is a drain pipe for discharging surplus water in the ground and debris such as earth and sand together with liquid supplied to the front of the diaphragm. The debris may be discharged by a screw conveyer known per se in place of the liquid transportation.

An internal gear 40 is mounted on the diaphragm 20 and an external gear 42 meshing with the internal gear 40 is mounted on the rotary head 16 respectively. In the embodiment shown, the internal gear 40 is provided on an inner peripheral surface of a cylindrical member 44 having a flange 43. The cylindrical member 44 is fixed to the diaphragm 20 by bolts 46 extending through the flange 43. On the other hand, the external gear 42 is provided on an outer peripheral surface of the cylindrical member 48 having a flange 47. The cylindrical member 48 is fixed to the rotary head 16 by bolts 50 extending through the flange 47. The crankshaft 24, internal gear 40 and external gear 42 rotated by the drive mechanism 30 constitute a planetary gear mechanism. When the crankshaft 24 is rotated, the rotary head 16 carries out the eccentric turning motion, and at the same time it is rotated forcibly by the engagement of the internal gear 40 with the external gear 42. The rotational direction of the rotary head 16 at that time is opposite to that of the crankshaft 24. Said eccentric turning motion of the rotary head 16 is a revolution around the axis of the shaft portion 25*a* of the crankshaft 24. Said rotation of the rotary head 16 is one on its own axis.

Figure 3:
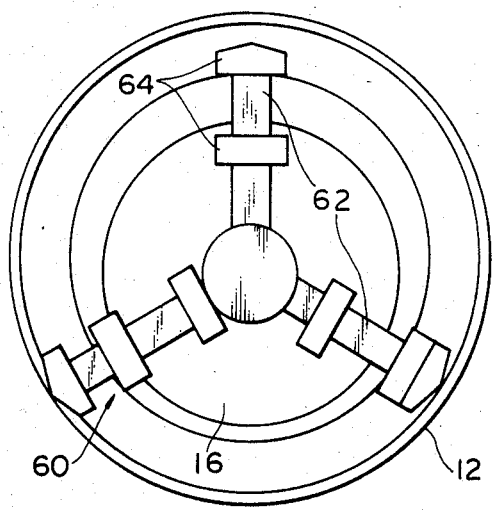
FIG. 3 is a small scale end view as viewed in the direction of the line 3—3 in FIG. 1.

As shown in FIGS. 1 and 3, the rotary head 16 is provided with a cutter assembly 60 fixed to the end portion. In the embodiment shown, the cutter assembly 60 includes a plurality of spokes 62 disposed radially from the rotary head 16 and a plurality of bits or tips 64 provided on the respective spokes. Instead of said embodiment a cutter assembly (not shown) known per se may be provided which includes a disk having at least a slit and a plurality of bits or tips projecting from said slit forward. The cutter assembly 60 is not needed and may be removed previously when the tunneling machine 10 is used for the soft ground.

To improve the function of the rotary head 16 for crashing the debris, especially gravel are provided a plurality of projections 66,68 having respective pointed ends on the inner peripheral surface 18 of the front portion 12*a* of the shield body and on the outer peripheral surface 17 of the rotary head 16. The projections 66,68 may be continuously or intermittently provided on said inner and outer peripheral surfaces 18,17 in the circumferential direction or provided spirally, continuously or intermittently.

The tunneling machine 10 is provided with a seal device 70 for sealing between the rotary head 16 and the diaphragm 20. The seal device 70 includes a ring 72 and a coil spring 74. The ring 72 is disposed on an outer periphery of the cylindrical member 48 in an inner peripheral groove 75 opened to the rear of the rotary head 16. The ring 72 can be moved axially of the crankshaft 24. On an outer periphery of the ring 72 is disposed an O-ring 76. The coil spring 74 is disposed in a hole 77 communicating to the inner peripheral groove 75 to press the ring 72 against the end face of the cylindrical member 44 and accomplish the sealing effet between the ring and the cylindrical member. Since the ring 72 is always pressed against the cylindrical member 44 by the spring 74 in said seal device 70, the sealing effect between both members can be maintained for a long time even if the ring 72 and the cylindrical member 44 wear at the contact area. Instead of the embodiment shown, the ring of said seal device may be disposed on the diaphragm 20 side to accomplish the sealing effect between the ring and the cylindrical member 48. In either case, between the ring 72 and the cylindrical member 44 is supplied lubricating oil stored in an oil bath 80 through paths 82,84,86 and 88, the bearing 28 and a path 90.

In the embodiment shown, the shield body 12 has the front portion 12*a* having the bore converging gradually rearward. While the rotary head 16 disposed in the front portion is generally conical, the frustconical or cylindrical rotary head may be used instead of the conical rotary head. When the rotary head is conical or frustconical, the bore of the shield body may be made approximately constant.

Hereinafter will be described the operation of the tunneling machine 10. When the crankshaft 24 is rotated by the drive mechanism 30, the rotary head 16 is turned with an eccentricity e from the center of the shield body 12. The turning direction is same as the rotational direction of the crankshaft 24. As the rotary head 16 is turned, the rotary head 16 will be revolved around the shaft portion 25*b* of the crankshaft 24 in the opposite direction to that of the crankshaft 24 since the engaging position of the external gear 42 fixed to the rotary head 16 with the internal gear 40 fixed to the diaphragm 20 is moved sequentially. Under this condition, when the thrusting jack (not shown) gives a thrust to the concrete pipe from the rear, the tunneling machine 10 advances and excavtes the face so that debris such as earth and sand received in the shield body 12 is condensed between the rotary head 16 and the shield body 12 and sent rearward. Thus, the debris reaching the debris chamber 38 is discharged through the pipe 36 to the rear of the diaphragm 20.

According to the present invention, the rotary head turning and revolving in the opposite direction to the turning direction and the whole inner peripheral surface of the shield body condense the debris received between them to linearly move and guide the debris to the drain port. Therefore, the friction acting between the debris, the diaphragm of shield body and other parts of the tunneling machine can be reduced. As a result, a relative compact drive unit can be used to rotate the rotary head and the cutter assembly. When the present invention is applied to the shield type tunneling machine for the pipe jacking method, the compact drive unit, i.e. the small diameter shield body can be realized.

What is claimed is:

1. A shield type tunneling machine comprising:

a shield body having a front portion converging gradually rearward;

a diaphragm provided in a rear of said front portion to cross said shield body;

a crankshaft rotatably journalled by the diaphragm and having one end connected to a drive mechanism provided in a rear of said diaphragm and the other end extending to a front of said diaphragm;

a conical or frustconical rotary head supported rotatably by said other end of the crankshaft so that the axis of the rotary head is eccentric to the axis of the crankshaft, the rotary head being disposed in the front portion of said shield body;

a gear mechanism for forcibly rotating said rotary head and including an internal gear fixed to one of said diaphragm and said rotary head and an external gear fixed to the other; and a means for discharging debris from a front area of said diaphragm to a rear area.

2. A shield type tunneling machine as claimed in claim 1, wherein sealing means is provided for sealing a gap between said diaphragm and said rotary head, said sealing means being provided in one of said diaphragm and said rotary head and including a ring movable axially of said crankshaft and a spring for deviating said ring to the other of said diaphragm and said rotary head.

3. A shield type tunneling machine as claimed in claim 1, wherein said rotary head is provided on a peripheral surface with a plurality of projections having respective pointed ends.

4. A shield type tunneling machine as claimed in claim 1, wherein said shield body is provided on an inner peripheral surface of said front portion with a plurality of projections having respective pointed ends.

5. A shield type tunneling machine as claimed in claim 1, wherein a cutter assembly is provided in a front end of said rotary head.

* * * * *